US007932492B2

(12) United States Patent
Demmons et al.

(10) Patent No.: US 7,932,492 B2
(45) Date of Patent: Apr. 26, 2011

(54) ELECTROSPRAY DEVICE

(75) Inventors: Nathaniel Demmons, Mason, NH (US); Roy Martin, Grafton, MA (US); Vladimir Hruby, Newton, MA (US); Thomas Roy, Newton, MA (US); Douglas Spence, Brookline, MA (US); Eric Ehrbar, Brookline, MA (US); Jurg Zwahlen, Ipswich, NH (US)

(73) Assignee: Busek Co. Inc., Natick, MA (US)

( * ) Notice: Subject to any disclaimer, the term of this patent is extended or adjusted under 35 U.S.C. 154(b) by 104 days.

(21) Appl. No.: 12/460,127

(22) Filed: Jul. 14, 2009

(65) Prior Publication Data

US 2010/0025575 A1 Feb. 4, 2010

Related U.S. Application Data

(60) Provisional application No. 61/137,410, filed on Jul. 30, 2008.

(51) Int. Cl.
*H01J 49/10* (2006.01)

(52) U.S. Cl. ..... 250/288

(58) Field of Classification Search ..... 250/288, 250/281, 423 R
See application file for complete search history.

(56) References Cited

U.S. PATENT DOCUMENTS 6,278,111 B1 * 8/2001 Sheehan et al. ..... 250/288

* cited by examiner

*Primary Examiner* — Kiet T Nguyen
(74) *Attorney, Agent, or Firm* — Iandiorio Teska & Coleman

(57) ABSTRACT

An electrospray device includes an electrospray emitter adapted to receive electrospray fluid; an extractor plate spaced from the electrospray emitter and having at least one aperature; and a power supply for applying a first voltage between the extractor plate and emitter for generating at least one Taylor cone emission through the aperature to create an electrospray plume from the electrospray fluid, the extractor plate as well as accelerator and shaping plates may include a porous, conductive medium for transporting and storing excess, accumulated electrospray fluid away from the aperature.

21 Claims, 9 Drawing Sheets

ELECTROSPRAY DEVICE

RELATED APPLICATIONS

This application claims benefit of and priority to U.S. Provisional Application Ser. No. 61/137,410 filed Jul. 30, 2008 under 35 U.S.C. §§119, 120, 363, 365, and 37 C.F.R. §1.55 and §1.78 incorporated herein by this reference.

Some work pertaining to this invention has been done under government contract: NASA NAS7-1407/Subcontract No. 1247199; United States Air Force FA8650-04-C2504; and HQ0006-05-C-7235. The Government may have certain rights under the subject invention.

FIELD OF THE INVENTION

This invention relates to an improved electrospray device and more particularly to an electrospray device which avoids excess accumulation of electrospray fluid.

BACKGROUND OF THE INVENTION

Basic operation of electrosprays is well-known and characterized in a large number of publications and used in many applications. Most of these applications are distinguished by relatively short-duration operation, especially where the electrospray is emitted through one or more apertures in grids composed of some solid material. During electrospray operation, and particularly during startup or with certain applied voltages and/or liquid flowrates applied to the electrospray, the electrospray may deposit some amount of sprayed liquid upon the solid edges of the grids (overspray), especially proximate the aperture. Accumulated build-up of this deposited liquid adversely impacts performance of electrospray operation over time, particularly when low vapor pressure liquids are used. Because this accumulation is gradual and most applications are short-duration, performance impacts had been negligible and no solutions to liquid accumulation had been sought.

For extended electrospray operation e.g. for durations exceeding 100 hours, or for particular operating conditions, no effective means for transport/removal of accumulated liquid exists. Consequently, duration of electrospray operation is limited to the point where the accumulated liquid interferes with, and ultimately prevents, proper function. Proper function is restored by performing manual cleaning of accumulated liquid and/or replacement of affected components.

Frequent cleaning or replacement of components is costly, and for applications where cleaning or replacement is impossible, the duration of electrospray operation is limited to the time it takes for some critical buildup preventing proper operation.

SUMMARY OF THE INVENTION

It is therefore an object of this invention to provide an improved electrospray device.

It is a further object of this invention to provide such an improved electrospray device which prevents buildup of excess electrospray fluid.

It is a further object of this invention to provide such an improved electrospray device which prevents back spray and shorting due to electrospray fluid accumulation.

It is a further object of this invention to provide such an improved electrospray device which enables extended operation and enables use in environments where cleaning or replacement is not practical.

It is a further object of this invention to provide such an improved electrospray device which reduces time and cost for cleaning or replacement necessitated by electrospray accumulation.

It is a further object of this invention to provide such an improved electrospray device which provides improved operation by eliminating the effect of free surfaces in electric fields affecting electrospray.

It is a further object of this invention to provide such an improved electrospray device which enables smaller and more compact devices through denser arrays of electrospray emitters.

The invention results from the realization that an improved electrospray device which reduces excess electrospray accumulation is achieved by making the extractor plate and one or more accelerator plates and shaping plates from a porous, conductive medium for transporting excess, accumulated electrospray fluid away from the aperature(s) in the plates.

The subject invention, however, in other embodiments, need not achieve all these objectives and the claims hereof should not be limited to structures or methods capable of achieving these objectives.

This invention features an electrospray device including an electrospray emitter adapted to receive electrospray fluid, an extractor plate spaced from the electrospray emitter and having at least one aperture, and a power supply for applying a first voltage between the extractor plate and emitter for generating at least one Taylor cone emission through the aperture to create an electrospray plume from the electrospray fluid, the extractor plate including a porous, conductive medium for transporting excess, accumulated electrospray fluid away from the aperture.

In a preferred embodiment the emitter may include a capillary tube for delivering the electrospray fluid. The emitter may include an externally wetted needle. The emitter may include a porous core with a circular emission rim. The emitter may include a porous core with a linear emitter. The electrospray fluid may include an ionic liquid. The electrospray fluid may include a mixture of ionic liquid and a solvent. The porous, conductive medium may include a metal. The porous, conductive medium may include a sintered metal. The aperture may include a hole. The aperture may include a gap distance from the extractor plate. There may be an accelerator plate spaced from the extractor plate on the other side from the emitter. The power supply may provide a second voltage between the extractor place and the accelerator plate. The second voltage may have the same polarity as the first voltage. The second voltage may have the opposite polarity from the first voltage. There may be shaping plate for shaping the electrospray plume. The shaping plate may be disposed between the emitter and the extractor plate. The power supply may apply a voltage to the shaping plate similar to that applied to the emitter. The shaping plate may include a porous, conductive medium. The accelerator plate may include a porous, conductive medium. At least one of the extractor, accelerators, and shaping plates may be connected to a liquid storage.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
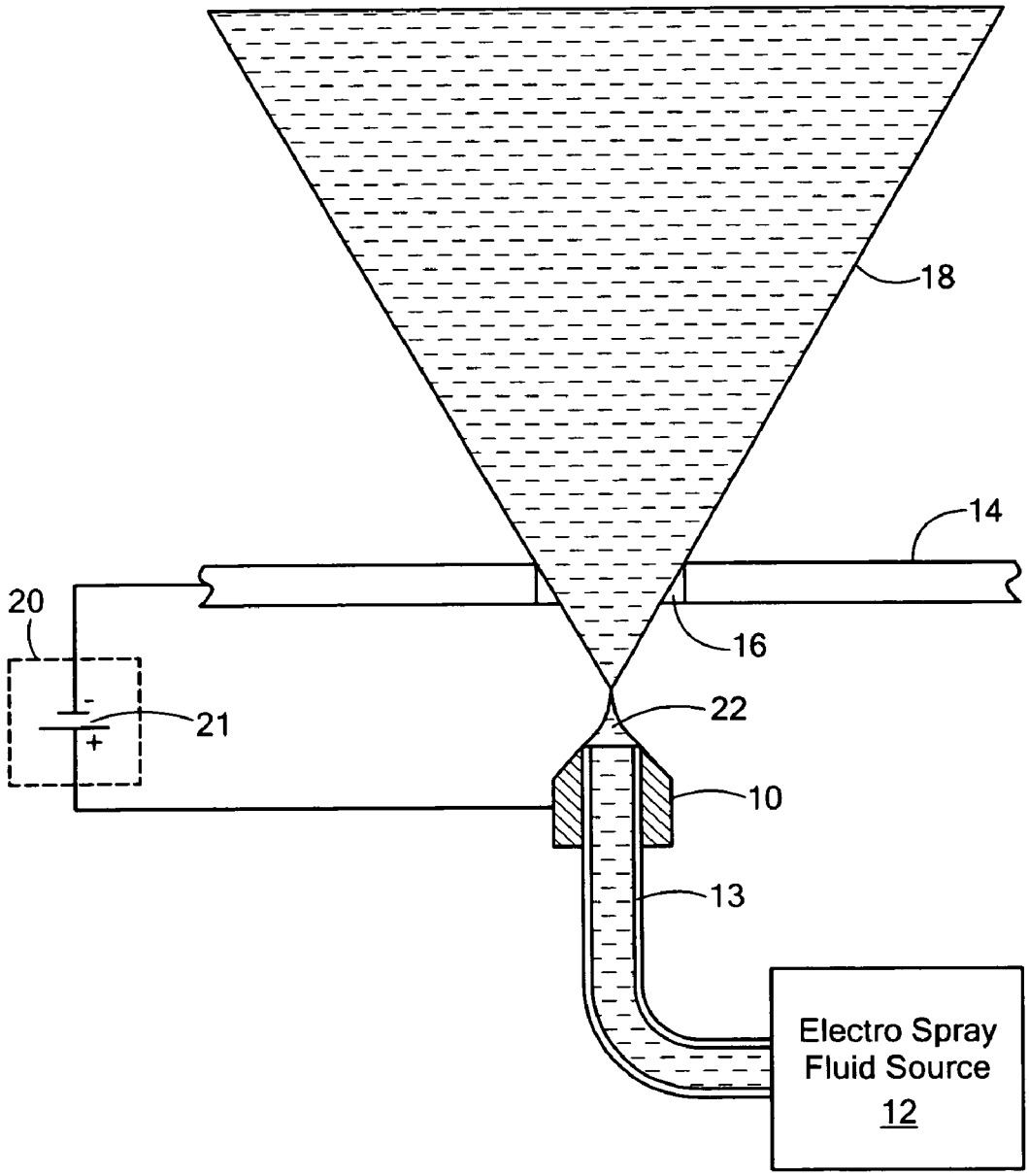
FIG. 1 is a schematic diagram of an improved electrospray device according to this invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

As explained in the Background, electrospray devices such colloid thrusters employ extraction and acceleration grids to create and accelerate liquid propellant as charged droplets and ions. A small fraction of the emitted propellant, usually much less than 1%, is intercepted by the grids where it may accumulate. The majority of this interception occurs during start up transients. Because the liquid is conductive, sufficient accumulation can bridge across high voltage gaps, and short the thruster, terminating its useful life or detrimentally altering the electrostatic field between the grids.

There is shown in FIG. 1 an electrospray device according to this invention including an emitter 10, which may be a capillary tube, adapted for connection to an electrospray fluid source 12 to receive electrospray fluid 13. There is an aperture plate 14, which in this configuration would typically be an extractor plate, having an aperture 16 through which the electrospray 18 is formed. A power supply 20 shown simply as a battery is connected across plate 14 and emitter 10 to create a voltage potential difference which results in a Taylor cone 22 being created. Power supply 20 can be a battery 21 connected as shown with the positive electrode connected to plate 14 and the negative to emitter 10 or the polarity may be reversed depending upon the configuration and application. It is the Taylor cone which results in the electrospray 18 and the concomitant thrust which is generated. The electrospray fluid may be a variety of materials preferably ionic materials such as available from Covalent Associates, Inc. of Corvallis, Oreg., Alfa Aesar of Ward Hill, Mass., and Sigma Aldrich of St. Louis, Mo. One of the desirable attributes of ionic fluids is that they have very low vapor pressure and so do not evaporate quickly. This normally beneficial feature contributes to the problem explained in the Background because when the electrospray fluid accumulates on plate 14 especially in and around aperture 16 it does not quickly evaporate.

Figure 2:
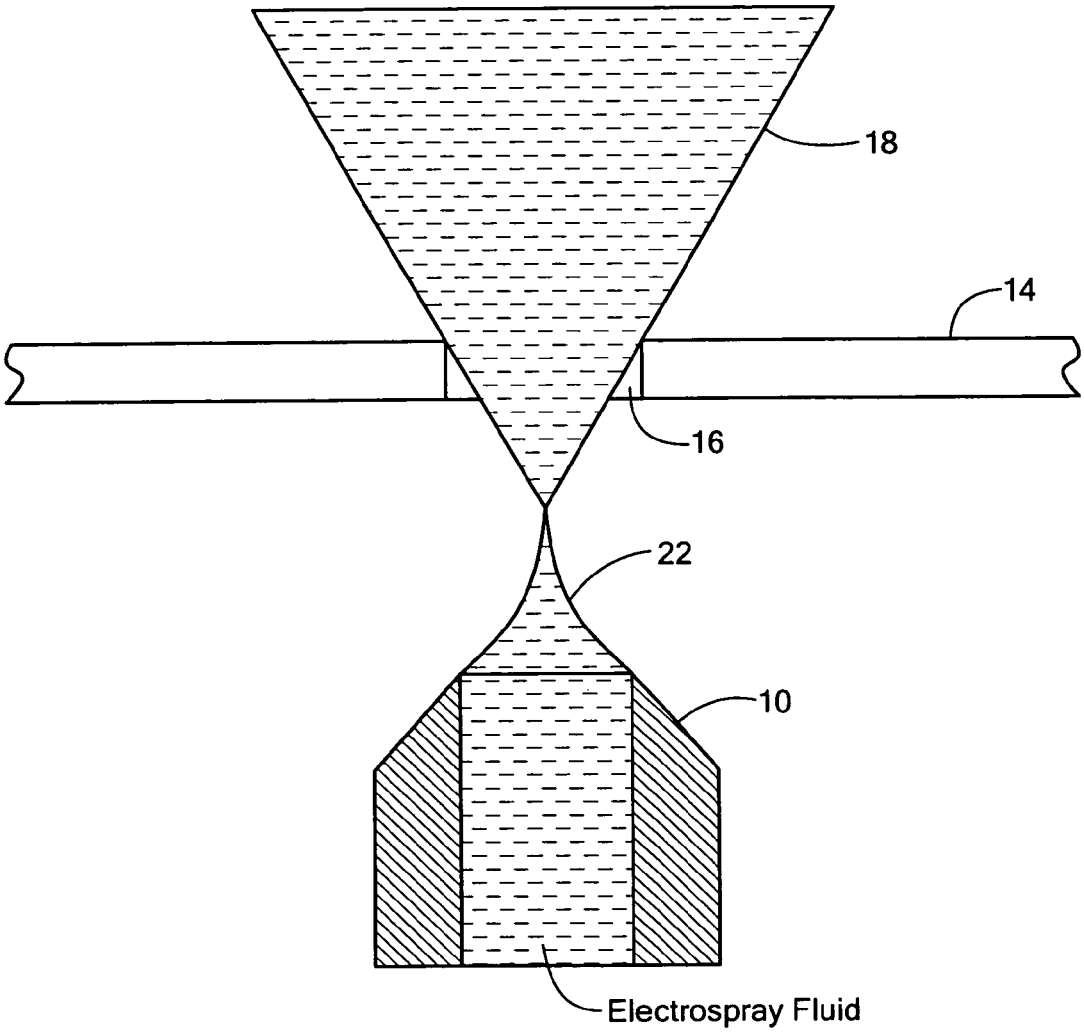
FIG. 2 is a more detailed, enlarged view of the capillary tube emitter of FIG. 1.

In accordance with this invention aperture plate 14 is made of a porous conductor. It is a conductor in order to contribute to the establishment of the electric field between emitter 10 and plate 14. In accordance with this invention it also must be porous. Metals are a good choice for plate 14, especially sintered metals. The porosity depends upon the viscosity and flowability of the electrospray fluid used. For example, using an electrospray fluid such as EMIIm available from Covalent Associates, Inc. plate 14 may be made of stainless steel and have a porosity of 0.5 μm. Using ionic fluid such as $EMIBF_4$ available from Alfa Aesar the plate 14 may be made of stainless steel and have a porosity of 0.5 μm. If the electrospray fluid is $EMIPF_6$ available from Sigma Aldrich then plate 14 may be made of stainless steel and have a porosity of 0.5 μm. By making plate 14 porous in accordance with this invention the excess electrospray fluid which would accumulate on plate 14 in and around hole 16 is instead wicked away and absorbed into the porous plate 14. The enlarged detail view of FIG. 2 shows the Taylor cone 22 more clearly. It is the Taylor cone that gives birth to the electrospray which forms through aperture 16. The invention is not limited to an emitter using only a capillary tube, such as shown in FIGS. 1 and 2.

Figure 3:
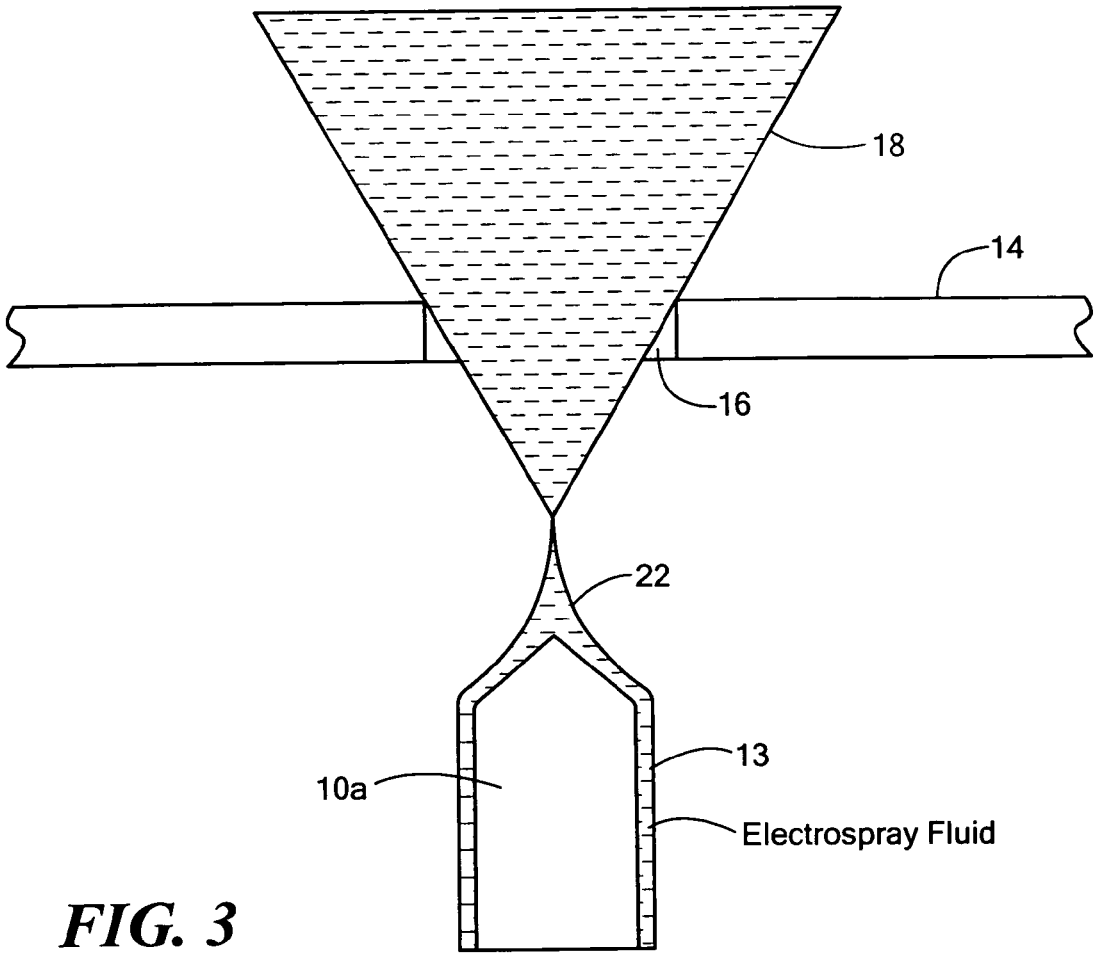
FIG. 3 is a more detailed, enlarged view of an externally wetted needle emitter.

In FIG. 3, Taylor cone 22 is created by the flow of the electrospray fluid 13 which flows around a needle emitter 10*a* to create the same phenomena of a Taylor cone 22 and electrospray 18 through aperture 16 of porous aperture (extractor) plate 14.

Figure 4:
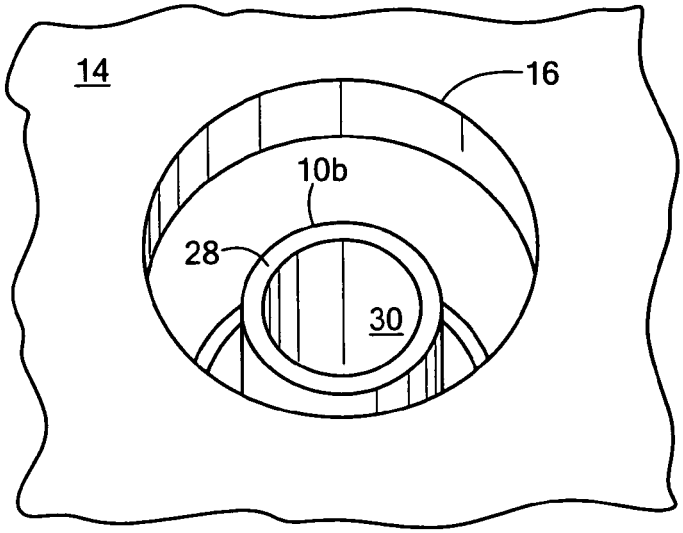
FIG. 4 is a more detailed, enlarged view of a porous core emitter with a circular emission rim.

In another alternative, FIG. 4, porous plate 14 according to this invention may be used with a circular emitter 10*b*, having an emission rim 28 around whose periphery a plurality of Taylor cones, not shown, are generated contributing to the electrospray 18, also not shown, generated through aperture 16. Emitter 10*b* with its emission rim 28 is supplied with electrospray fluid 13 from an electrospray fluid source via a circular emission source, center core 30, which may also be a type of porous material to feed the fluid up in a controlled fashion to emission rim 28.

Figure 5:
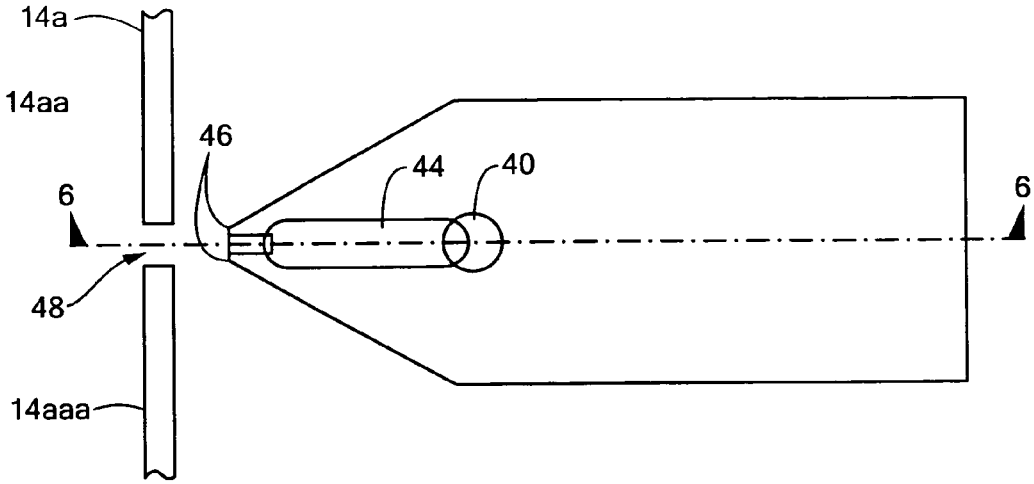
FIG. 5 is a schematic more detailed, enlarged side view of a linear emitter with a gap aperture.
Figure 6:
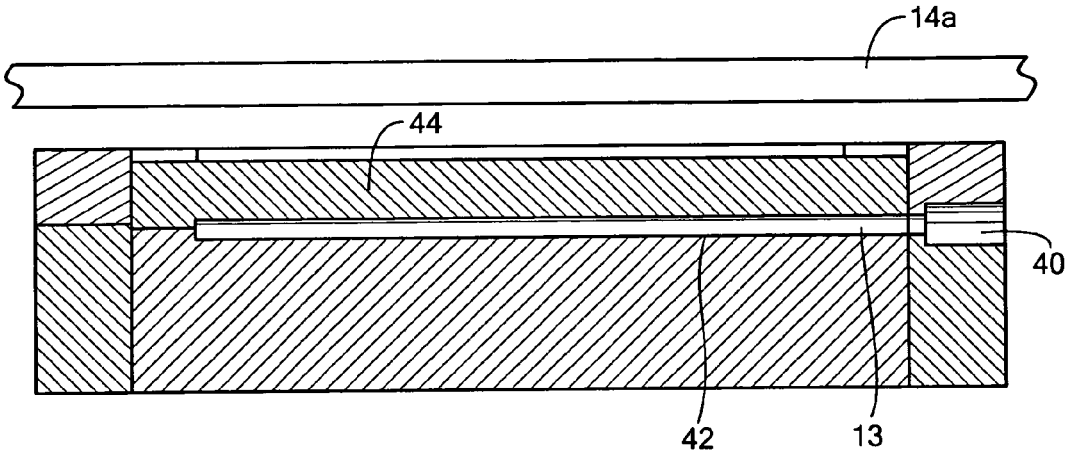
FIG. 6 is a schematic sectional view along lines 6-6 of FIG. 5.

While thus far the porous plate 14 according to this invention has been shown with an aperture that is basically a hole or a round opening this is not a necessary limitation of the invention for as shown in FIGS. 5 and 6, here referred to together, the fluid may be fed into a propellant inlet 40 from thence to an elongated manifold pipe 42 not visible in FIG. 5, which feeds the electrospray fluid to a porous core 44 that in turn delivers the electrospray fluid 13 to the emission area or split ridge 46. Here the aperture plate 14*a* has an elongate slot or gap 48 for the aperture instead of a hole or a more rounded opening. Split ridge 46 is formed by a space between the two halves 14*aa* and 144*aaa* of plate 14*a*.

Figure 7:
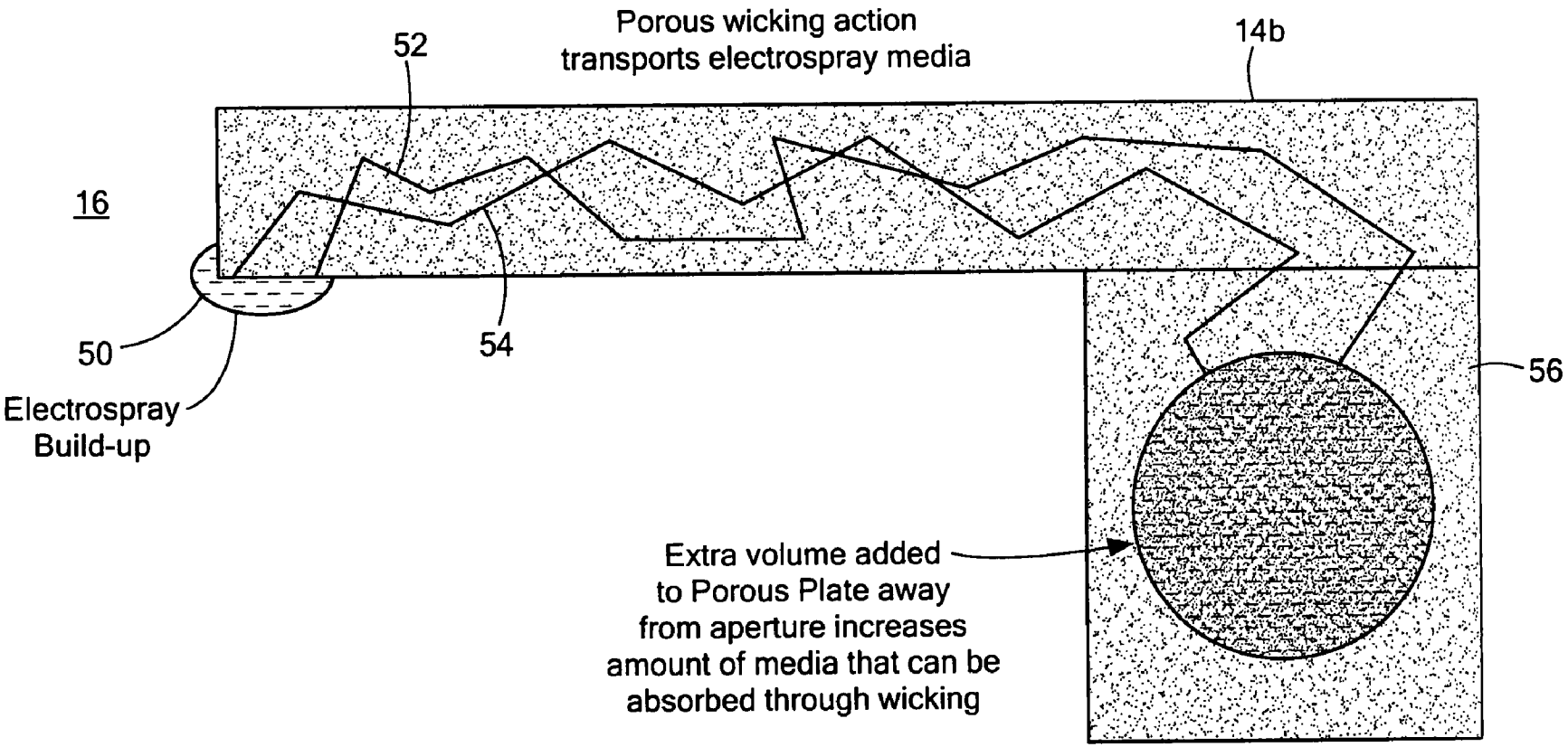
FIG. 7 is a side, sectional schematic view of a portion of an aperture plate illustrating the wicking away of electrospray accumulation from the aperture area to a reservoir where the accumulated fluid is stored.

The action promoted by the porous structure of the aperture plate according to this invention is shown in FIG. 7 where aperture plate 14*b* is shown having an electrospray buildup 50 concentrated in the area of aperture 16. Due to the porosity of plate 14*b* this electrospray fluid 50 is wicked away as indicated by the random paths of lines 52 and 54 for example to distal portions of aperture plate 14*b*. In a preferred embodiment of the invention aperture plate 14*b* may be connected with an added volume of porous material 56 which acts as a reservoir to receive even more of the electrospray fluid which is wicked away through the absorbing nature of plate 14*b* and proximate areas of porous reservoir 56 which may be made of the same material as plate 14*b*.

Figure 8:
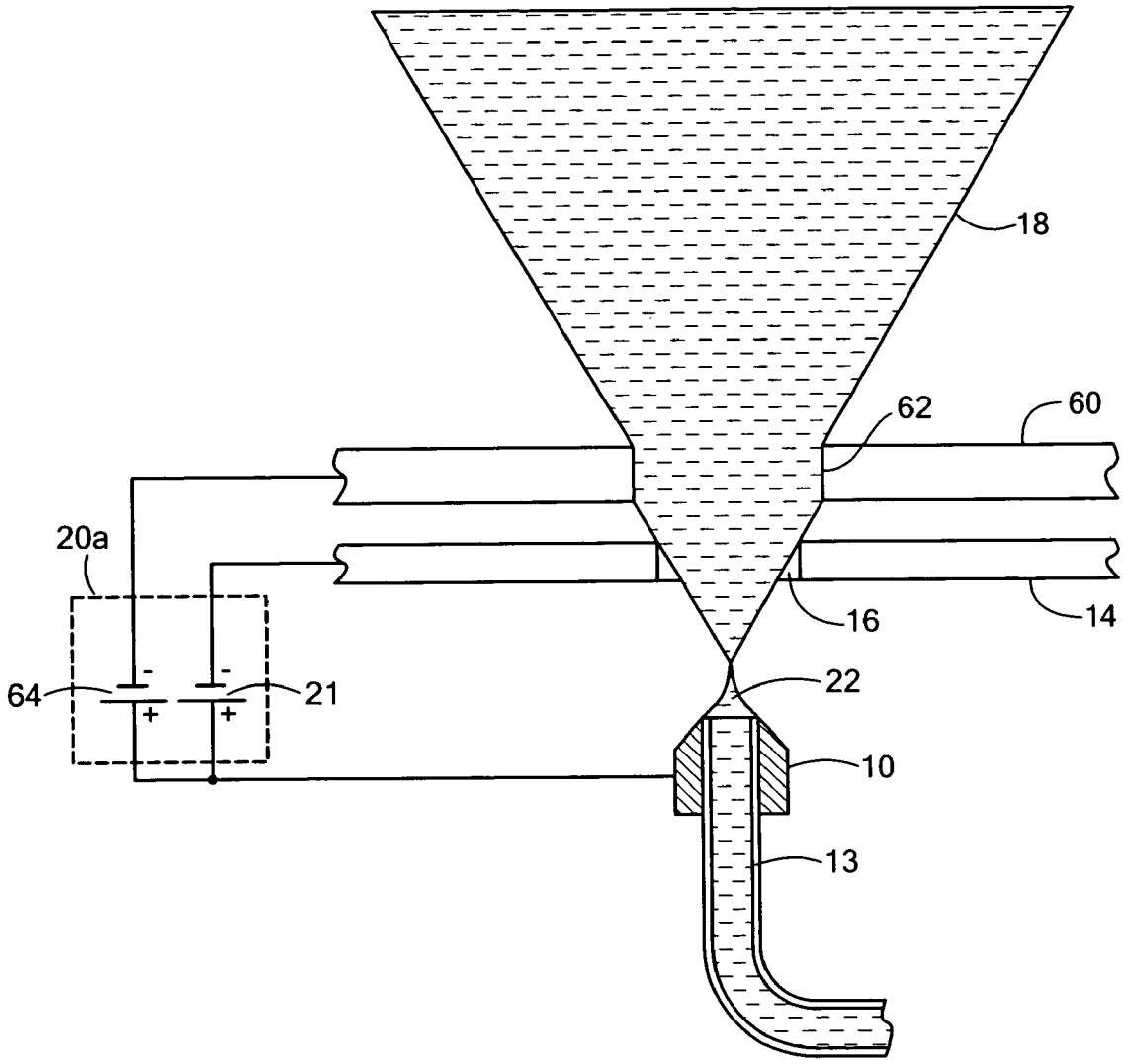
FIG. 8 is a view similar to FIG. 1 showing two aperture plates, an extractor plate and an accelerator plate.

Although thus far the invention has been applied to a single aperture plate, typically the extractor plate of an electrospray device, this is not a necessary limitation of the invention. For example, as shown in FIG. 8, plate 14 is an extractor plate accompanied by a second aperture plate, accelerator plate 60, having a similar aperture 62. Accelerator plate 60 may be a porous medium, too. Accelerator plate 60 is also connected to power supply 20*a* which now includes a second voltage source shown simply as a battery 64. In this case battery 64 polarizes accelerator plate 60 with the same polarity as that of extractor plate 14 with respect to emitter 10 but this is not a necessary limitation for the accelerator to be at a negative voltage, in which case the polarity connection of battery 64 to plate 60 would be reversed.

Figure 9B:
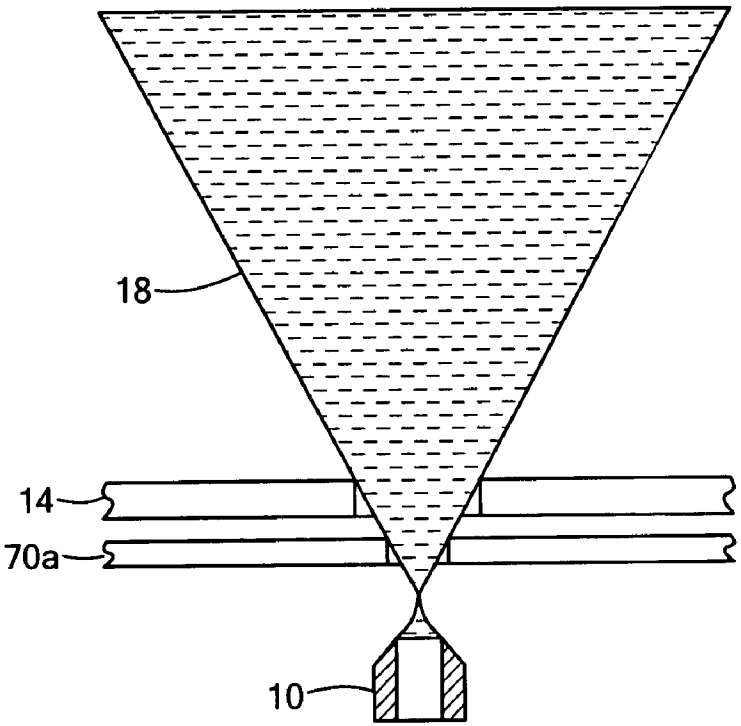
FIGS. 9A-E are views similar to FIGS. 1 and 8 illustrating only a few of the aperture plate arrangements that can be effected by the invention.
Figure 9A:
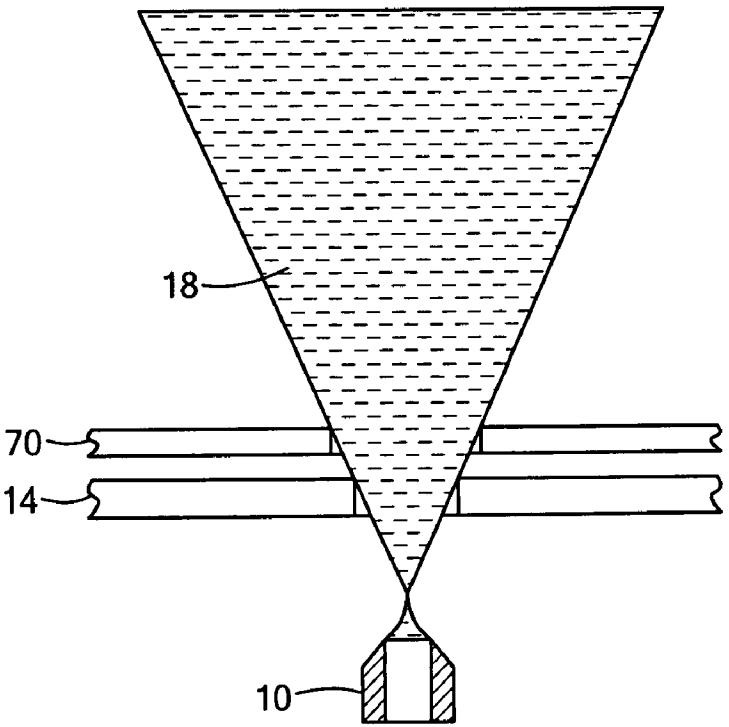
Figure 9D:
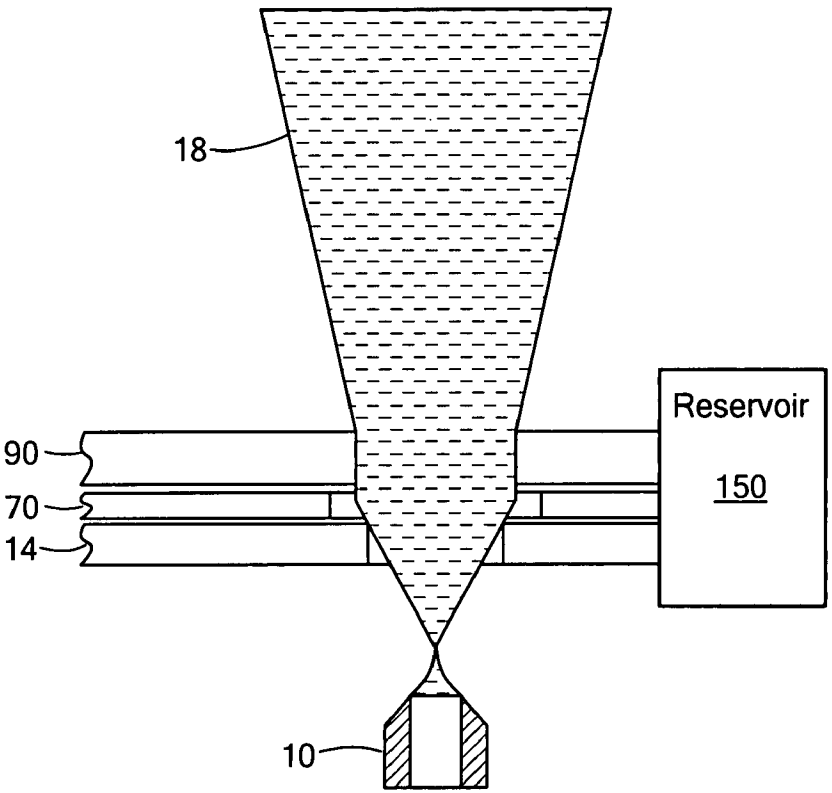
Figure 9C:
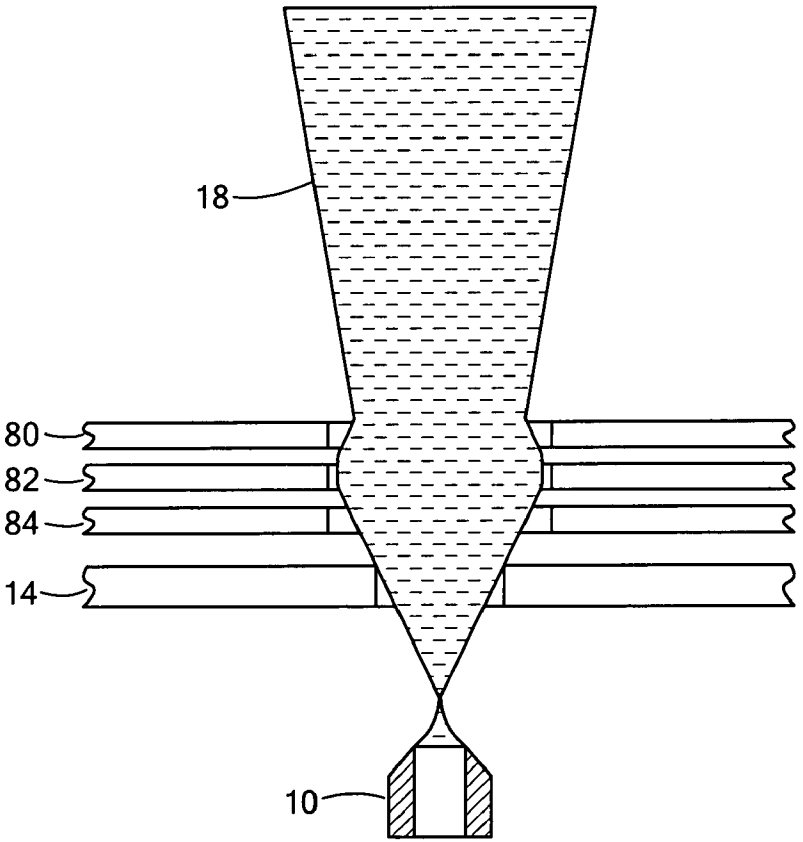
Figure 9E:
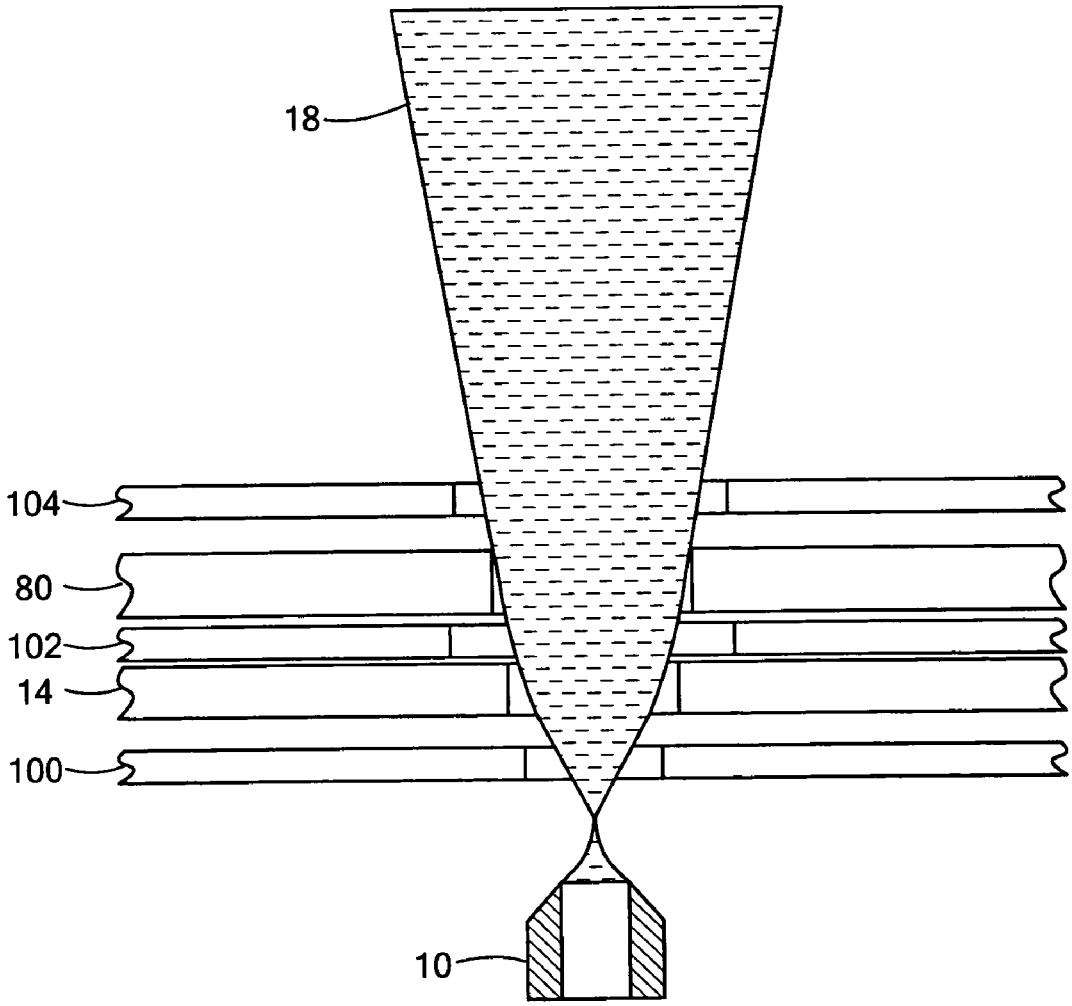

The invention is applicable to all manner of arrangements and configurations of aperture plates, shaping electrodes and the like. Some examples of the variety of aperture plates including extractor plates, accelerator plates, shaping electrodes and lenses which are accommodated by this invention are shown in FIGS. 9A-E. For example in FIG. 9A, extractor plate 14 is accompanied by a shaping electrode 70 for shaping the electrospray. In this case the shaping electrode 70 would also be porous in accordance with this invention. In FIG. 9A, the shaping electrode 70 is on the opposite side of extractor plate 14 from emitter 10. This is not a necessary limitation as the shaping electrode 70*a*, FIG. 9B, may be closer to emitter 10 while extractor plate 14 is farther from it. In FIG. 9C extractor plate 14 is accompanied by a set of shaping electrodes 80, 82, 84 which together form an Einzel Lens for procuring a particular shape to electrospray 18. In FIG. 9D, a shaping electrode 70 is positioned between extractor aperture plate 14 and accelerator aperture plate 90. Any or all of the extractor plate 14, accelerator 90, and one or more shaping electrodes 70 may be connected to liquid resolve 150 which may be porous as shown in FIG. 7. In FIG. 9E, extractor plate 14 and accelerator plate 80 are positioned interstitial three shaping electrodes 100, 102, and 104.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An electrospray device comprising:

an electrospray emitter adapted to receive electrospray fluid;

an extractor plate spaced from said electrospray emitter and having at least one aperture; and a power supply for applying a first voltage between said extractor plate and emitter for generating at least one Taylor cone emission through said aperture to create an electrospray plume from said electrospray fluid, said extractor plate including a porous, conductive medium for transporting excess, accumulated electrospray fluid away from said aperture.

2. The electrospray device of claim 1 in which said emitter includes a capillary tube for delivering the electrospray fluid.

3. The electrospray device of claim 1 in which said emitter includes an externally wetted needle.

4. The electrospray device of claim 1 in which said emitter includes a porous core with a circular emission rim.

5. The electrospray device of claim 1 in which said emitter includes a porous core with a linear emitter.

6. The electrospray device of claim 1 in which said electrospray fluid includes an ionic liquid.

7. The electrospray device of claim 6 in which said electrospray fluid includes a mixture of ionic liquid and a solvent.

8. The electrospray device of claim 1 in which said porous, conductive medium includes a metal.

9. The electrospray device of claim 1 in which said porous, conductive medium includes a sintered metal.

10. The electrospray device of claim 1 in which said aperture includes a hole.

11. The electrospray device of claim 1 in which said aperture includes a gap distance from said extractor plate.

12. The electrospray device of claim 1 further including an accelerator plate spaced from said extractor plate on the other side from said emitter.

13. The electrospray device of claim 12 in which said power supply provides a second voltage between said extractor plate and said accelerator plate.

14. The electrospray device of claim 13 in which said second voltage has the same polarity as said first voltage.

15. The electrospray device of claim 13 in which said second voltage has the opposite polarity from said first voltage.

16. The electrospray device of claim 12 in which said accelerator plate includes a porous, conductive medium.

17. The electrospray device of claim 1 further including a shaping plate for shaping said electrospray plume.

18. The electrospray device of claim 17 in which said shaping plate is disposed between said emitter and said extractor plate.

19. The electrospray device of claim 18 in which said power supply applies a voltage to said shaping plate similar to that applied to said emitter.

20. The electrospray device of claim 18 in which said shaping plate includes a porous, conductive medium.

21. The electrospray device of claim 1 in which at least one of said extractor, accelerators, and shaping plates are connected to a liquid storage.

* * * * *